US011209248B2

(12) United States Patent
Knutson

(10) Patent No.: US 11,209,248 B2
(45) Date of Patent: Dec. 28, 2021

(54) TARGET TURNING SYSTEM

(71) Applicant: Shot Bot LLC, Columbia, MO (US)

(72) Inventor: Kris Knutson, Columbia, MO (US)

( * ) Notice: Subject to any disclaimer, the term of this patent is extended or adjusted under 35 U.S.C. 154(b) by 0 days.

(21) Appl. No.: 16/568,204

(22) Filed: Sep. 11, 2019

(65) Prior Publication Data

US 2020/0080822 A1 Mar. 12, 2020

Related U.S. Application Data

(60) Provisional application No. 62/730,293, filed on Sep. 12, 2018.

(51) Int. Cl.
*F41J 7/00* (2006.01)
*F41J 9/00* (2006.01)

(52) U.S. Cl.
CPC .. *F41J 7/00* (2013.01); *F41J 9/00* (2013.01)

(58) Field of Classification Search
CPC . F41J 7/06; F41J 1/10; F41J 7/00; F41J 7/04; F41J 11/00; F41J 5/14; F41J 9/00; F41J 5/00; F41G 3/26; G09B 9/003
See application file for complete search history.

(56) References Cited

U.S. PATENT DOCUMENTS 4,372,175 A * 2/1983 Parker ..... B01L 3/0227 73/864.17
4,889,346 A * 12/1989 Destry ..... F41J 7/00 273/406
4,934,937 A * 6/1990 Judd ..... F41G 3/2655 273/371
5,603,505 A * 2/1997 Acock ..... F41J 7/06 273/391
2007/0291938 A1* 12/2007 Rao ..... G09G 5/006 380/210
2010/0225062 A1* 9/2010 Shum ..... F41J 7/06 273/359
2011/0263309 A1* 10/2011 Gowin ..... G07F 17/3225 463/16
2015/0260487 A1* 9/2015 Steil ..... F41J 5/14 273/390
2016/0054104 A1* 2/2016 Harris ..... F41J 7/00 273/368
2016/0195369 A1* 7/2016 Perry ..... F41J 5/04 434/19
2017/0059288 A1* 3/2017 Campbell ..... F41J 7/04

OTHER PUBLICATIONS

"Elite Target Systems Proficiency Through Training & Practice", Apr. 4, 2008, elitetargetsystems.com, <<https://web.archive.org/web/20080404121636/http://www.elitetargetsystems.com/taciihomepage.html> (Year: 2008).*

* cited by examiner

*Primary Examiner* — Justin L Myhr
(74) *Attorney, Agent, or Firm* — The Law Firm of Brett M. Maland

(57) ABSTRACT

The present invention is directed towards a target shooting system with novel function allowing it to incorporate various targets sizes and quantities, as well as different shooting configurations by means of remote triggers.

15 Claims, 6 Drawing Sheets

TARGET TURNING SYSTEM

CROSS REFERENCE TO RELATED APPLICATION

This document claims priority to U.S. Provisional App. No. 62/730,293 entitled "Target Tuning System" filed on Sep. 12, 2018.

FIELD

This document relates to the field of target systems for shooting.

BACKGROUND

Law enforcement agencies are being challenged to not only maintain but advance their firearms training and certifications. Advanced firearms classes are offered to help educate agents and train for specialized line of duty threat scenarios. Examples of these scenarios include low-light reaction, surprise shoot/no shoot situations, "officer down" positions, ambush, engaging multiple targets and various real-world simulations.

Existing target systems do not provide the function to allow agencies to focus training on their specific real world scenarios. Existing target systems are too simple in terms of function to prepare agencies for the complexities and range of scenarios encountered in the real world. These systems do not provide flexibility or networking. While existing target systems are too simple in function, the mechanical design and function is overly complex so that existing target systems require specialized equipment or personnel to operate and repair. Additionally, ETS usually require vendor specific targets and don't adapt to the required sanctioned targets (IE. law enforcement action targets, US military, DOJ and DOD targets, 3d silhouette targets "IVANS"). The agencies will "make due" based on what is setup or working at the various shooting ranges or training facilities, losing vital training productivity.

SUMMARY

To address the problems and shortcomings of existing target systems and facilitate a higher level of firearms training, the present invention is a rotating portable target system developed to be affordable, durable and easy to use and also has novel functions that allow it to operate as an effective simulator of real world scenarios. The present invention allows the user the ease to quickly setup multiple targets of varying size and weight in minutes and activate the targets remotely. The structure enables portability which allows the needed flexibility to setup in existing structures like warehouses, schools or churches for use with replica or non-lethal firearms. The remote trigger apparatus can be deployed to create target turning events for specialized training and even advanced ambush training.

Solving the existing target systems' downtime caused by the harsh environments and mechanical failure is critical. The present invention is designed for easy "in the field" replace or repair. Additionally, the present invention portable target turning apparatus can be adapted to use any of the various industry and government sanctioned targets. This adaptability not only allows for sanctioned certifications but ultimately saves in the overall operating cost.

Much of the following is intended to provide context to the claims. The context, which could sometimes be referred to as examples, should not be interpreted as to limit the claimed invention.

In the preferred embodiment, the invention is comprised of at least a plurality of target apparatus, and at least one remote controller, wherein the at least one remote controller is configured to send outgoing signals and receive incoming signals with the plurality of target apparatus and wherein the plurality of target apparatus are configured to turn targets of varying mass and form. The outgoing signals and incoming signals are comprised of various data related to the invention, namely shooting related data, including data related to how the system is configured to resemble various real world scenarios. The communication between a plurality of devices allows for the flexibility to set up complex, real world scenarios to prepare users for warfare or mass shooting situations, for example. The remote controller can be a remote sensor, but is typically a device capable of receiving complex input in the typical embodiment. Such a device includes a smartphone but can also include a more complex, future device or a simple, dedicated controller.

In a more specific embodiment, the inventions outgoing signals and incoming signals are wireless. This allows for the additional flexibility in setting up the system.

In another specific embodiment, the plurality of target apparatus have housings, the housings each covering a shaft receiver, a motor, electronics package and a power supply. The housing protects the operating portions of the target apparatus. Including each of these components is preferred for additional flexibility in setting up the system.

In another specific embodiment, the invention has a plurality of remote controllers, each configured to send outgoing signals and receive incoming signals with each of the plurality of target apparatus. In typical embodiments, the invention will include multiple controllers, which can be configured as sensors, such as motion sensors, and at least one controller, such as a smartphone configured to communicate and program the system.

In another specific embodiment, the plurality of target apparatus have motors powered by internal batteries, and wherein the power supply is configured to be pulsed at varying pulse intervals. Pulsing the motor is the preferred means for adjusting the turning results so that the target apparatus can be used for targets of varying mass and form. The targets are connect to the invented target apparatus.

In another specific embodiment, the invention further comprises a plurality remote controller apparatus configured to receive input initiated by a human or remote controller sensor triggered events and to send outgoing signals and receive incoming signals with the plurality of target apparatus and at least one remote controller.

In another specific embodiment, the plurality of target apparatus have shafts that turn targets, and the shafts are in communication with switches on a start point and an end point, the target apparatus further comprising a timer that times the amount of time for the shaft to turn from the start point to the end point for a given amount of time. The use of a switch or switches allows for the target to stopping force to be measured. The measurement is likely most closely related to mass, but form of the target will likely also be a factor due to drag. For targets that are difficult to stop, the pulsing will be adjusted to decrease the speed of the target turning, and therefore reduce the force needed to stop the target at the desired turn point. This allows for a more robust and lasting target apparatus.

In another specific embodiment, the invention has a plurality of remote controllers, with at least one remote controller configured to receive intentional input from a user, and at least one remote controller configured to receive motion input from a user. Generally, at least one remote controller that can receive intentional input is preferred. Sensors that trigger the turning of targets are also preferred.

In the related preferred embodiment of implementing the invention, the method of the invention is comprised of a plurality of target apparatus configured to transfer data between the target apparatus and at least one remote controller, the method comprising the steps of: determining the unique and group identifiers of each of the plurality of target apparatus, wherein the identifiers comprise a portion of the data, building a target sequence structure for the plurality of target apparatus based on intentional input from a user, wherein the target sequence structure comprises another portion of the data, executing the target sequence structure, and recording a status for each target, wherein the status comprises another portion of the data. The group identifiers can be selected based on what group the shooter or user is supposed to be included in. Multiple groups are possible, and a specific shooter can be in multiple groups. The target identifier should be unique to the range of the system or the range of the controllers.

In a more specific embodiment of the invented method, at least a portion of the data transferred is encrypted. Encrypted data protects against interference.

In a more specific embodiment of the invented method, the method is further comprised of performing parity checks on the data transferred and wherein the data is transferred through radio frequency channels. The parity checks confirm that the data transferred between the various components are consistent and therefore legitimate.

In a more specific embodiment of the invented method, the method is further comprised of an initialization phase and an operation phase for each target apparatus, such that in the initiation phase, a motor in each individual target apparatus turns a shaft on each target apparatus one or more times during an initialization phase and determines a time taken for the target apparatus to turn, subsequently, adjusting the power pulsed during the operation phase based on the time taken for the target apparatus to turn during the initialization phase. The initialization phase allows the system to determine a stopping force so that the power delivered to the motor can be adjusted based on what stopping force. This allows the apparatus to be used for varying target masses and forms. The targets are interchangeable between the target apparatus.

In a more specific embodiment of the invented method, the method is further comprised of a step configured to allow a user to program various functional commands, which include turning speed, rotation direction, turn action, delay time, permanent memory update, random function execution, transmit function, retransmit function, basic functional parameter changes in the data structure transmit the data structure to apparatus in the target turning system on the target turning network and display operational indication of execution status.

In a more specific embodiment of the invented method, the method is further comprised of the steps of determining the unique and group identifiers of a plurality of remote controllers, building a target sequence structure that includes the plurality of remote controllers and target apparatus.

In a more specific embodiment of the invented method, at least one remote controller is a plurality of remote controllers, with at least one remote controller configured to receive intentional input from a user, and at least one remote controller configured to receive motion input from a user.

In a more specific embodiment of the invented method, the target apparatus has a motor configured to pulse its output.

In a more specific embodiment of the invented method, at least one of the plurality of the target apparatus have a shaft for turning targets, the shaft having a switch or switches to determine a start point and an end point for the shaft's turn.

In a more specific embodiment of the invented method, at least one of the target apparatus is configured to time the amount of time taken for the shaft to turn between the start point and end point.

In another preferred embodiment, the invented system is comprised of a target turning network comprising a plurality of target apparatus and a plurality of remote controllers, wherein each are configured to transmit outgoing signals and receive incoming signals, and wherein at least one remote controller configured to receive intentional input from a user, and at least one remote controller configured to receive motion input from a user.

In a more specific embodiment of the preferred embodiment is where the outgoing signals and incoming signals are wireless.

In the preferred embodiment of the individual target apparatus, the invention is comprised of a motor, a power source configured to pulse power to the motor at varying pulse intervals, a shaft configured to hold a target, a timing mechanism configured to time the amount of time taken for the shaft to turn, a recording mechanism configured to record the power pulsed to the motor, a transmitting mechanism configured to transmit data, a receiving mechanism to receive data, wherein at least one component of the data is an identifier of the target apparatus.

DETAILED DESCRIPTION OF DRAWINGS

The present invention is a target turning system. Preferably the target turning system is comprised of one or a plurality of; a portable target turning apparatus, an app controller and a plurality of remote triggers. The system is configured as a flexible network. Explanations and descriptions.

The following disclosure provides many different embodiments, or examples, for implementing different features of the provided subject matter. Specific examples of components and arrangements are described below to simplify the present disclosure. These are, of course, merely examples and are not intended to be limiting. For example, the invention always includes a remote controller, and in the most preferred embodiment, there are multiple remote controllers, with at least one remote controller being further specified as an app controller and at least one remote controller being further specified as a remote trigger. While this section primarily addresses the system as including both the app controller and remote trigger, the invention is intended to be broad enough to capture the use of either one. Additionally, the apparatus can be plural or singular as used in this application.

The invention is a shooting target, and more specifically a flexible target apparatus and a network that can include generic target apparatus and the flexible target apparatus.

The software method is referred to as the target turning system software method and it facilitates a flexible network of target apparatus that, in the preferred embodiment, comprise a plurality of target apparatus that can be triggered by one or more app controllers and one or more remote triggers. For the remainder of this application, an app controller shall be a device that can receive intentional input from a user. This allows for a target sequence structure to be programmed, among other things. In this programming phase, which would be the first part of an initialization stage, a sequence for the targets could be set. An additional initialization step includes testing for the force needed to stop a target that is turning, which is explained more later. Additionally, other parameters could be set, such as functional commands, which are described more later in this application, but control the proximity to trigger a remote sensor that would trigger a target to turn, for example. The capability for the target turning system software method is programmed in each microchip included in the electronics package of the apparatus. The target turning system software method will execute various functions. Those functions include determining unique network grouping and apparatus identifiers, encryption and decryption of the data that is transmitted and received between the various components, and adaptation of the turning parameters based on the target object form and mass.

Figure 4:
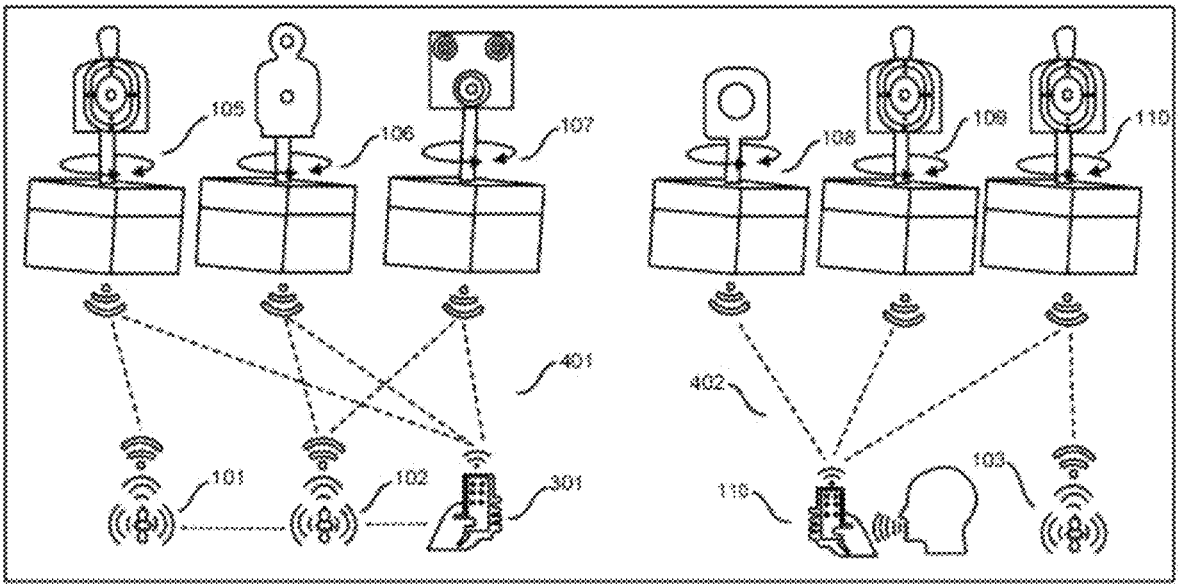
FIG. 4 is a target turning system with multiple groups.

The method includes determining unique network grouping and apparatus identifiers, preferably controlled through the app controller or some other central control, wherein the app controller identifies one or more target apparatus, such as 105 and 106 in FIG. 4, and then groups the target apparatus into an associated group, such as 401. In one embodiment, the target turning apparatus are identified based on unique configurations of dip switches. In other embodiments, each target apparatus has a fixed identifier, and the app controller is programmed to move target apparatus into a live target turning system, and into a selected group. In the most basic embodiment, the app controller is comprised of a single button controller. In the preferred embodiment, the app controller has six inputs and the remote trigger is triggered by one input, typically motion within a given distance range, such that when a human user comes into range of a sensor, wherein such range could be programmed in the most preferred embodiment, triggering the motion sensor which causes a target apparatus to turn. The app controller can also have no buttons and be triggered with voice commands.

The data transmitted and received includes sensor information received by the remote triggers, information related to target hit accuracy, information related to the configuration and location of the network of target apparatus, functional commands (described later), sensor data, apparatus specific data, data structure meta data, parity check information, packet data, encryption information and times stamps. The data may be displayed on the app controller or online. The data may be displayed in various configurations based on user selection. The data is encrypted to protect against tampering, which is desirable in applications of confidential nature or high stakes competitions.

The target apparatus turn targets and can turn targets of various weights and forms. Target apparatus 106, 107, and 108 all turn different targets and those targets can be switched because the target apparatus of the invented system. During an initialization stage (referring to FIG. 6), the motor 607 of the target apparatus will turn the shaft 606 which is connected to a target (shown in FIGS. 1-4, but not numbered). The shaft 606 sits in adaptable receiver structure 605. In the preferred embodiment, the receiver 605 has a collar 609. The collar has an irregularity or irregularities that provide a start point 610 and an end point 611 for rotation. When the shaft 606 rotates (the shaft is connected to a target, which can be various targets, but is not show in FIG. 6), the receiver 605 rotates, as does the collar 609. The collar is in communication with a has a start point and end point and the time it takes for the motor 607 to turn the shaft 606 and target is proportional to the weight or mass of the target. There are other ways known in the art for determining the force needed to stop the target, and this invention is not intended to be limited to any one, even though that described is the preferred. For heavier targets, the turn during initialization will take longer than the turn for lighter targets. During operation, the power that is supplied to the motor 607 will be pulsed at slower intervals making it easier for the target to be stopped after turning. The turns are rapid in operation, and slower during the initialization stage. Turns are typically 180 degrees, but this can be adjusted.

In the target turning system software method, one or a plurality of the apparatus will communicate with each apparatus, referred to as the target turning network. Through the target turning system software method, the target turning network of apparatus is enabled for the automatic and dynamic addition and removal of apparatus in the target turning network. One or a plurality of the target turning network is designed so the apparatus can function independently in separately grouped networks. Detailed examples further in this document show how dynamic and adaptive the target turning network is. The users of the apparatus can add and remove apparatus as well as build additional groups of apparatus quickly and dynamically to facilitate the requirements of the training scenarios. The user can also configure the system so that the apparatus will be removed based on whether it is hit or not, or hit in the target area or not.

In the case of firearms training, a simple example of a basic target turning system is; one app controller and two portable target turning apparatus. For example, a user will press an action key such as "random" on the app controller. This action will cause the app controller to randomly pick a portable target turning apparatus and transmit the "random" command to the portable target turning apparatus. The portable target turning apparatus will then execute the random command. The motor in the portable target turning apparatus to turn on and rotate the target object with a random interval for the shooter. A maximum interval is set and it is adjustable.

An example of a more complex target turning network is; multiple portable target turning apparatus with multiple remote trigger apparatus. In the case of advanced law enforcement or military firearms training, the apparatus are placed in doorways, rooms, hallways or courtyards of a church, school, warehouse or parking lot. The portable target turning apparatus will hold the target. Several targets could be designated as "don't shoot" targets or friendly targets in contrast to the actual targets. The trainee, using nonlethal firearms, can advance on the training course. A sensor in the remote trigger apparatus will trigger and transmit an action for the portable target apparatus to activate the motor.

Another key embodiment is the adaptability to use different target objects. These target objects can vary in form and mass from paper plates to 3-dimension targets or metal targets. Ultimately, this saves in the operational cost to operate this target turning system.

Figure 1:
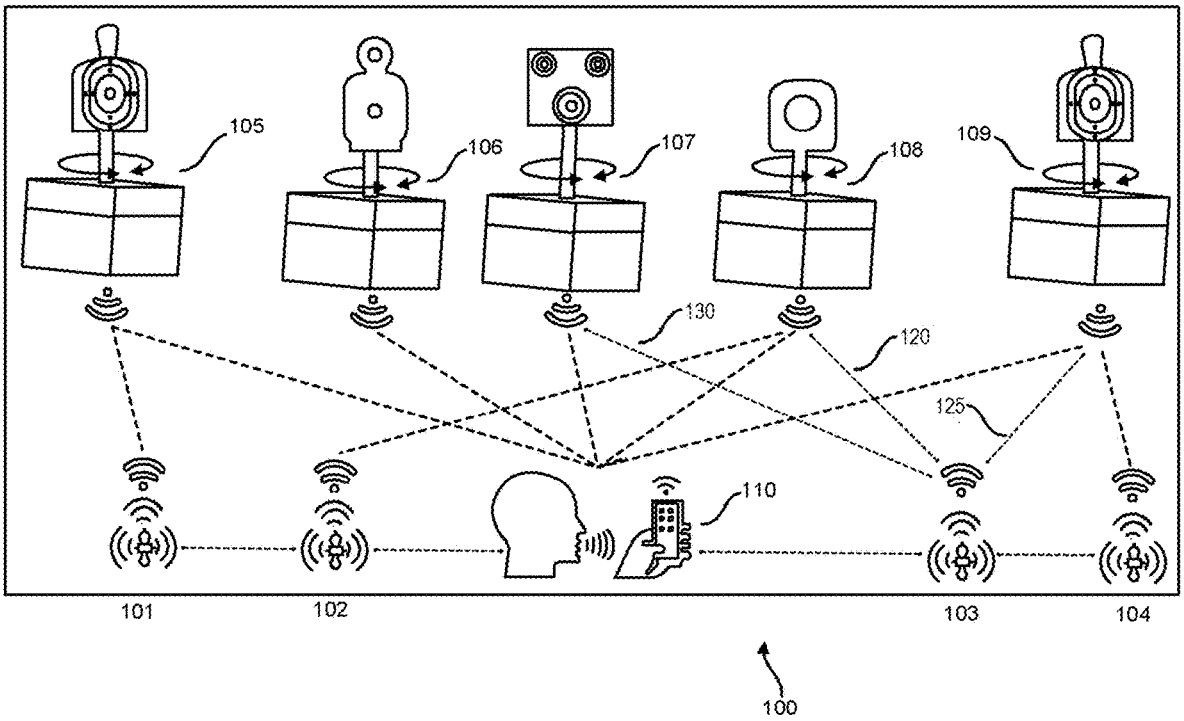
FIG. 1 is a target turning system with remote sensors.
Figure 2:
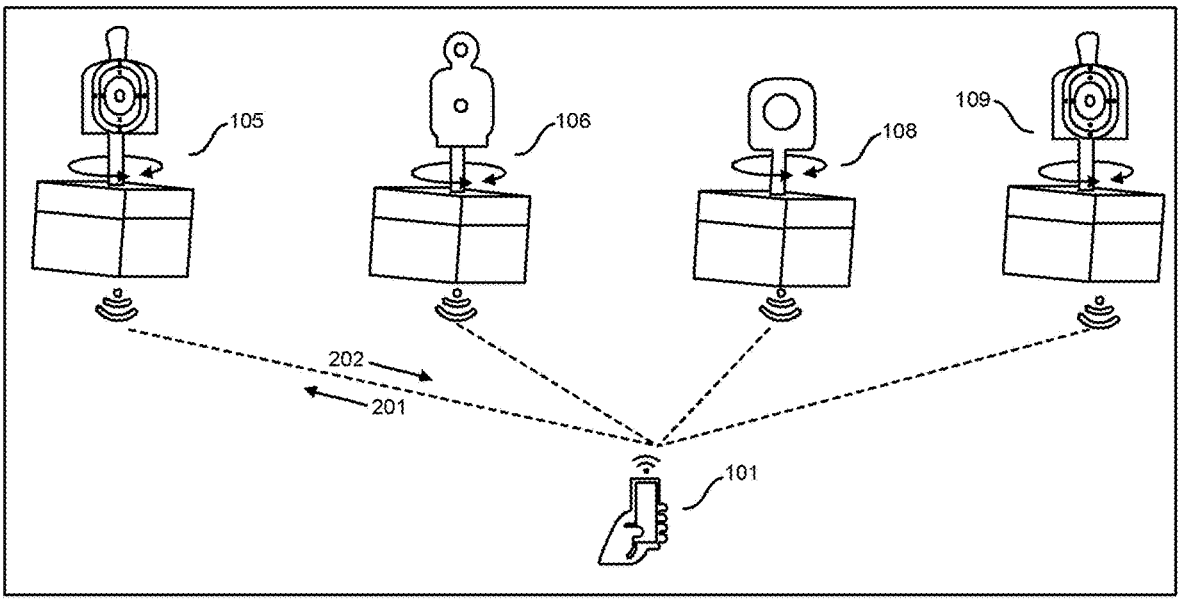
FIG. 2 is a target turning system in an embodiment without remote sensors.

FIG. 2 is the basic embodiment of the overall system showing one app controller 101 sending signals 201 and receiving signals 202 on a single network from four portable target turning apparatus 105, 106, 108, and 109. For the preferred embodiment, for all figures, the dotted lines shown between the target apparatus and remote controllers are intended to be two way, as with 201 and 202. While only the signals from remote trigger 103 going to target apparatus 107, 108, and 109 are shown, it is intend that each remote controller will be in communication with each target apparatus, and that communication could all go through the various remote controllers, such as the plurality of remote controllers 101, 102, 103, and 104 in FIG. 1. FIG. 1 is an example of the preferred embodiment showing additional function. FIG. 1 shows a target turning system 100 including, one or more portable target turning apparatus 105, 106, 107, 108, and 109, one or more remote trigger apparatus 101, 102, 103, and 104, and one or more app controller 110. The remote triggers can be networked to more than one target apparatus, such as with 120, 125, and 130. In the preferred embodiment, connections 120, 125, and 130 are wireless. While limited in these figures, the connections 120, 125, and 130 connecting remote controller 103 with target apparatus 107, 108 and 109, controller 103 is in communication with controller 110, which is in communication with 102, so all can be connected. All apparatus will execute the target turning system software method and all apparatus will operate within, one or a plurality of the target turning network of grouped apparatus.

Figure 3:
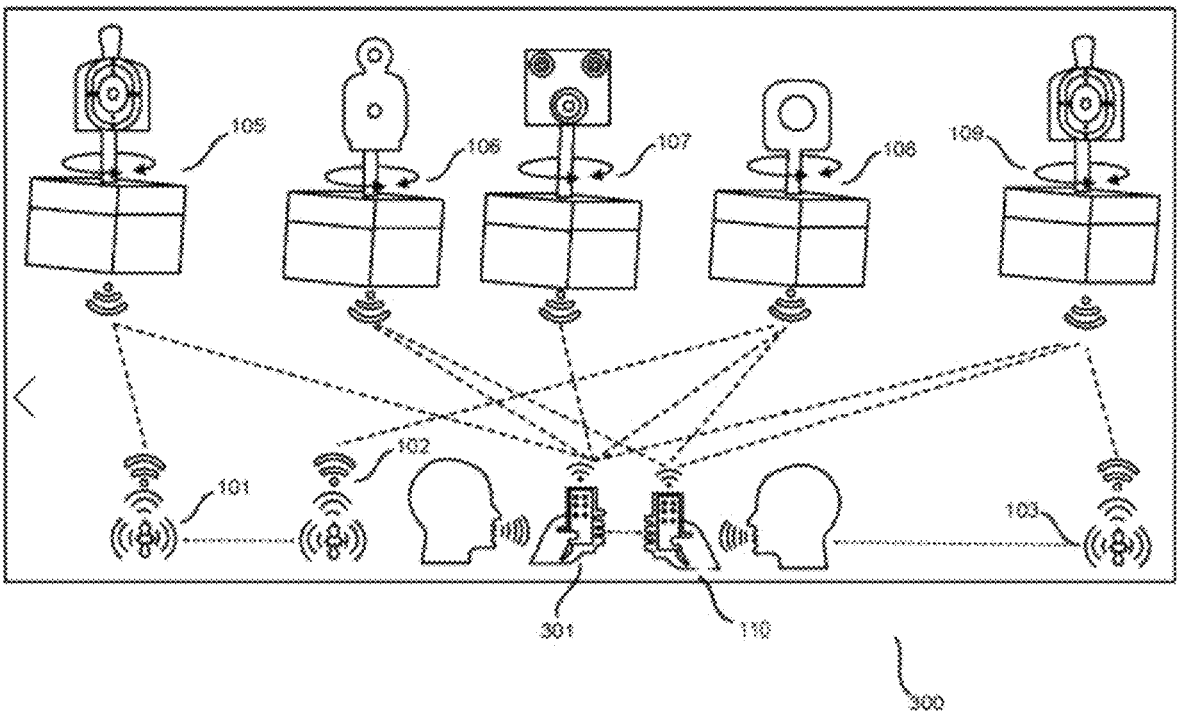
FIG. 3 is a target turning system with multiple controllers.

FIG. 3 is an example of an expanded configuration. This configuration is a single network 300 with a plurality of remote trigger apparatus 101, 102, and 103, app controller 302 and 301 and portable target turning apparatus 105, 106, 107, 108, and 109. FIG. 4 is an example of two target turning networks 401 and 402 within each network. The example shows a plurality of portable target turning apparatus 105, 106, 107, 108, 109, and 110, a plurality of remote triggers 101, 102, and 103 and an app controller 101 and 301 for each network. The diagrams of the present invention show examples of flexibility and adaptability. The diagrams are intended to show the possibility of configurations and are not limited to the diagrams as shown.

Figure 5:
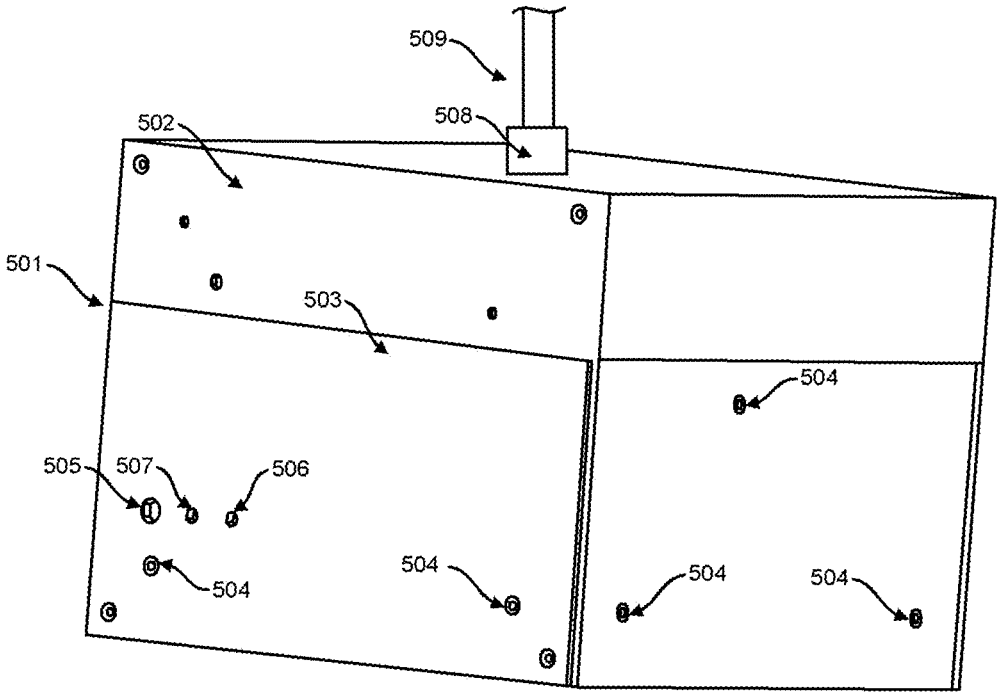
FIG. 5 is a target turning apparatus with a housing.

According to various embodiments of the target turning system, the portable target turning apparatus, with overview FIG. 5 and comprising of a housing 501 wherein the housing contains the mechanical infrastructure, power supply and electronics package. Preferably the electronics package is executing the target turning system software method. The external embodiment of the portable target turning housing includes bolting and lug mechanics 504 for add-on features. These features incorporate, but are not limited to, physical and environmental stabilization, as well as mechanical and functionality additions. A removable lid 502 covers the portable target turning housing. The removable lid is designed to allow the adaptable receiver shaft infrastructure access 508 (605 in FIG. 6) for external placement of the adaptable shaft holding infrastructure 509 (606 in FIG. 6). Preferably this is an access hole for the shaft to fit through but is not limited to an access hole. Other mechanical methods are possible to transfer mechanical motion from the inside the portable target turning apparatus to the outside the removable lid. The housing will allow internal access via a back-side access panel 503. This panel is designed for ease of access to the mechanical infrastructure and electronics package. The external embodiments of the portable target turning housing also include; ON/OFF switch infrastructure 505 an alternative power supply connector infrastructure 506 and external wire connector infrastructure 507.

Figure 6:
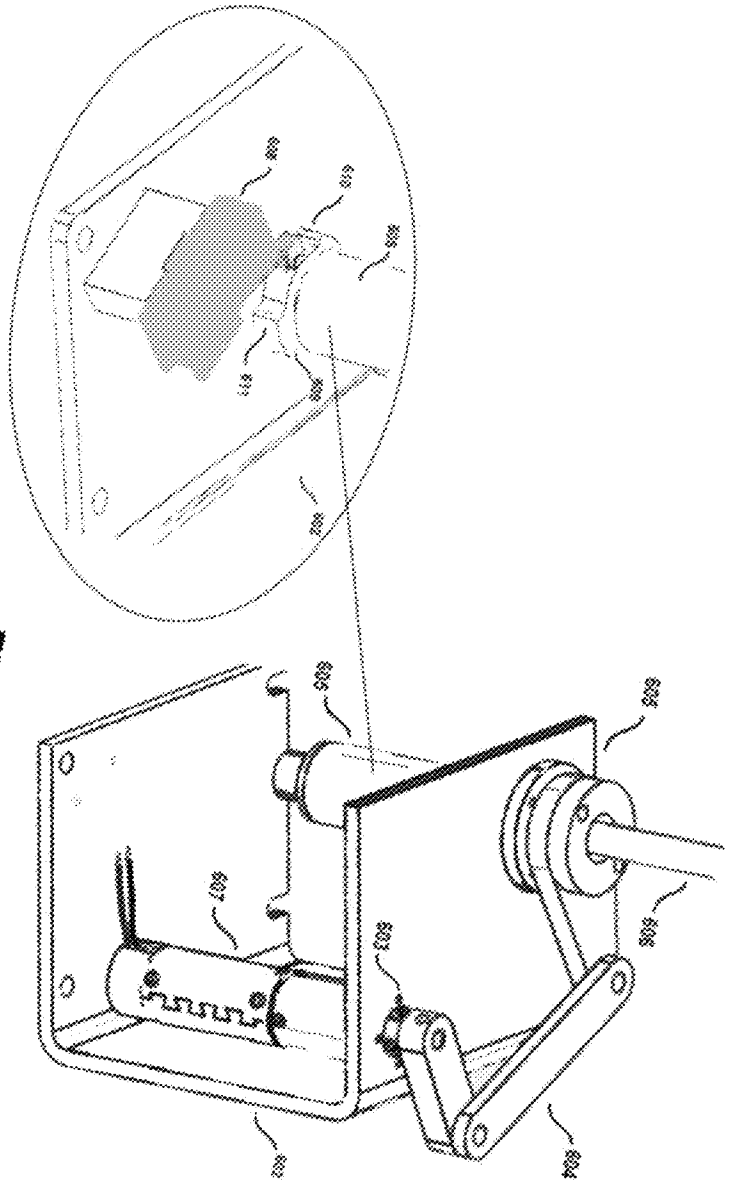
FIG. 6 is a target turning apparatus without a housing.

FIG. 6 shows the portable target turning mechanical infrastructure includes, but are not limited to; preferably a mechanical infrastructure bracket 602, a motor infrastructure bracket 603, adaptable receiver shaft mechanics 604, adaptable receiver shaft infrastructure 605, and an adaptable shaft holding infrastructure 606 (or the plurality of brackets, motors, adaptable receiver mechanics, adaptable receiver shafts and adaptable holding shafts). Individually the motor and shaft are mounted to the mechanical infrastructure bracket. The power supply (or plurality of power supplies) is connected to the motor 607. The motor is articulated via the electronics package. The gearing from the motor and adaptable receiver shaft mechanics is designed to rotate the shaft. The shaft can turn 360 degrees and is not limited to only clockwise rotation. Counter clockwise rotation is possible. The shaft comprises of an adaptable receiver shaft and an adaptable shaft holding infrastructure to allow for target object placement and adaptability of differing target objects. The connection is not limited to a male to female connection. A spindle and hub or clamping design can be used to adjust the shaft for desired target display. The bracket at the end of the shaft assembly is designed to bolt on and adapt to a mounting plate for any type of targets. The power supply (or plurality of power supplies) is typically 12V DC. The power supply is not limited to only a 12V battery and can also be AC. An AC to DC transformer or an externally connecting power sources can be used.

According to various embodiments, the present invention includes the remote trigger apparatus comprising of a housing wherein the housing contains the mechanical infrastructure, power supply and electronics package. Preferably the electronics package is executing the target turning system software method. The remote trigger apparatus will receive input from the various sensors, buttons or keys. Other inputs can be received from other apparatus transmitted on the target turning network. The power supply (or plurality of power supplies) is typically 5V DC. The power supply is not limited to only a 5V battery and can also be AC. An AC to DC transformer or an externally connecting power sources can be used.

The present invention includes; the app controller comprising of a housing wherein the housing contains the mechanical infrastructure, power supply and electronics package. Preferably the electronics package is executing the target turning system software method. Preferable the app controller will receive input from the various sensors, buttons or keys. Other inputs can be received from other apparatus transmitted on the target turning network.

According to various embodiments of the present invention all apparatus will have an electronics package executing the target turning system software method. The programming is copyrighted in accordance to software laws. It is designed to execute commands from either the wireless transmitted data structure or the physical wired buttons and/or keys. The execution and actions are caused by the results of inputs. The electronics package contains a printed circuit board (PCB), including a microchip, and power control switches. It generally further includes LED's, display device for operational indication or other visual messages, relays, sensors and transmission electronics capable of receiving and transmitting the data structure and grouping the apparatus on the target turning network. The electronics package could also reside in a computing device like a mobile computing or laptop. Preferably the signals are Radio Frequency (RF) but are not limited to RF. Wireless, Cellular, Bluetooth, LIFT or future wireless technologies are acceptable. Wired buttons, keys, sensors and switches can be used for executing the various commands. The electronics package is not limited to only receipt of the transmitted command. The electronics package can transmit as well to other apparatus in the target turning network. The transmission of the data structure is encrypted but is not limited to encryption. A plurality of portable target turning apparatus, app controller and remote trigger apparatus allow each apparatus to receive and transmit commands to and from each apparatus in the target turning network while executing commands in the target turning system software method. The apparatus has the flexibility and adaptability to allow for user-controlled identification of the apparatus as well as apparatus groupings. This allows for multiple groupings of apparatus to transmit the data structure to be acknowledged by only an apparatus identified as being in the same group FIG. 2. Examples of grouping but not limited to groupings in the target turning network of apparatus are as follows: FIG. 3 Shows a single network with plurality of app controller with plurality of remote trigger apparatus. To demonstrate a complex example a with plurality of target turning network groupings FIG. 4 shows two networks with a plurality of app controllers, a plurality of remote triggers apparatus and plurality of portable target turning apparatus in each network. Each apparatus can act as a sender or transmitter each grouping in the target turning network. The benefit of this methodology of groupings of apparatus is to allow for different portable targets turning apparatus, app controller and remote trigger apparatus functioning independently within each group in the target turning network. The programming of the microchip is not limited to existing code within the microchip. Parameters, variables and functionality can be adjusted via buttons, keys, onboard USB port, SIM, web or mobile computing connectivity.

Preferably the target turning system software method in all apparatus is designed to adjust and adapt to the addition or removal of apparatus in the target turning network of varying size of the targets and can also be adjusted to a number of functional commands. It is not limited to only receiving input from its sensors, buttons or keys, it can relay the information to the other apparatus in the target turning network. It will also adjust functionality based on number of apparatus in the grouping as they are removed or added. Additionally, the software will accept user input and variable adjustments which are functional commands. These inputs and adjustments are not limited to manual buttons or sensors. Web or mobile variables and parameters can be used to reprogram functionality on the apparatus. At "Startup and Initiation" but not limited to, the unique identifier and unique grouping identifier will be stored in memory. This identification is set via but not limited to DIP switches or other adjustable set switches. Global functions and data structures are initialized along with parity check variables, encryption, decryption, transmit and receive structures and other functions.

Preferably the target turning system software method in the portable target turning apparatus is designed to adapt to the form, mass and forces required to turn the shaft. This dynamic adaptation will result in the target turning without putting too much force on stopping heavier targets and the turning action happens rapidly such that the slower turn is not perceptible to the human eye or is just barely noticeable. This is regardless of what kind of target object is attached to the portable target turning apparatus. This allows for the flexibility to attach targets from paper plates, 3 dimensional gel filled human looking targets, often call Ivan's targets, and metal targets. The portable target turning apparatus will receive the transmitted data structure as input resulting in the execution of the command. This execution will be the activation of a relay that turns the motor on. The motor movement will turn the motor mechanics to the shaft. The programming of the microchip is not limited to existing code within the microchip. Reprogramming can be adjusted via onboard USB, SIM, web or mobile connectivity.

Preferably the target turning system software method in the app controller is designed to query all apparatus in the target turning system and store in its memory the data structure for each apparatus, display operational indication of execution status. Next during the continuous loop execution, the apparatus will accept human activated input from the user interface. This input is primarily the pressing of buttons but are not limited to physical buttons on the app controller. Other user interface input can be used, like hands-free activation, touch pad or sensors. The commands from the activation will be transmitted to the apparatus in the target turning network for execution. Some examples of these commands known as functional commands, are ON/OFF, DELAY, TURNS, SHOW, NEXT, SEQUENCE, RANDOM, FAKE TURNS. Other commands and parameters could be, turning speed, rotation direction, turn action, delay time, permanent memory update, random function execution, transmit function, retransmit function. Additionally, visual information and sensor information is displayed. This information includes but not limited to function status of the target turning system apparatus. Other information including hit counts, turn counts, reaction time and basic shooter information is displayed on the app controller. The programming of the microchip is not limited to existing code within the microchip. Reprogramming can be adjusted via onboard USB, SIM, web or mobile connectivity.

Preferably the target turning system software method in the remote trigger apparatus at the initialization functional execution will power up the sensor or plurality of sensors. This activation will allow the gathering of external sensor information storing this information in memory and display the operational indication of execution status. Next during the continuous loop execution, the remote trigger apparatus will build the data structure based on the input from the sensors. Based on this data, it will execute functions but not limited to functional commands. A simple example of the remote trigger apparatus is to transmit the command for a portable target turning apparatus to activate its motor and turn the target with the default delay. A more complex example is the remote trigger apparatus to transmit to all apparatus a random turn action to all targets in the target turning network with a delay of 4 seconds. This trigger event is activated from a sound sensor detecting the trainee. The programming of the microchip is not limited to existing code within the microchip. Reprogramming can be adjusted via onboard USB, SIM, web or mobile connectivity.

This invention has been described in specific detail with reference to the disclosed embodiments, it will be understood that many variations and modifications may be affected within the spirit and scope of the invention as described in the appended claims.

I claim:

1. A target turning system comprising of a plurality of target apparatus, and at least one remote controller, wherein the at least one remote controller is configured to send outgoing signals and receive incoming signals with the plurality of target apparatus and wherein the plurality of target apparatus are comprised of a housing at least partially enclosing a shaft receiver configured to hold a shaft coupled to a target, a motor configured to receive pulses of power at varying time intervals, an electronics package, a power supply, and a timer, wherein the timer measures the time that it takes for the shaft to turn during an initiation phase, and wherein the electronics package is programmed to adjust the time intervals of the pulses of power sent to the motor based on the time it takes for the shaft to turn such that the target turning system is configured to automatically adjust to turn targets of varying mass and form.

2. The system of claim 1, wherein the outgoing signals and incoming signals are wireless.

3. The system of claim 1, having a plurality of remote controllers, each configured to send outgoing signals and receive incoming signals with each of the plurality of target apparatus.

4. The system of claim 1, wherein the plurality of target apparatus have motors powered by internal batteries, and wherein the power supply is configured to be pulsed at varying pulse intervals.

5. The system of claim 1, further comprising a plurality remote controller apparatus configured to receive input initiated by a human or remote controller sensor triggered events and to send outgoing signals and receive incoming signals with the plurality of target apparatus and at least one remote controller.

6. The system of claim 1, wherein the plurality of target apparatus have shafts that turn targets, and the shafts are in communication with switches on a start point and an end point, the target apparatus further comprising a tinier that times the amount of time for the shaft to turn from the start point to the end point for a given amount of time.

7. The system of claim 1, having a plurality of remote controllers, with at least one remote controller configured to receive intentional input from a user, and at least one remote controller configured to receive motion input from a user.

8. A computer implemented method of operating a plurality of target apparatus configured to transfer data between the target apparatus and at least one remote controller, the method comprising the steps of: determining the unique and group identifiers of each of the plurality of target apparatus, wherein the identifiers comprise a portion of the data, building a target sequence structure for the plurality of target apparatus based on intentional input from a user, wherein the target sequence structure comprises another portion of the data, executing the target sequence structure, and recording a status for each target, wherein the status comprises another portion of the data, further comprising an initialization phase and an operation phase for each target apparatus, such that in the initiation phase, a motor in each individual target apparatus turns a shaft on each target apparatus one or more times during an initialization phase and determines a time taken for the target apparatus to turn, subsequently, adjusting the power pulsed during the operation phase based on the time taken for the target apparatus to turn during the initialization phase.

9. The method of claim 8 wherein at least a portion of the data transferred is encrypted.

10. The method of claim 9, further comprising the steps of performing parity checks on the data transferred and wherein the data is transferred through radio frequency channels.

11. The method of claim 8 further comprising the steps of determining the unique and group identifiers of a plurality of remote controllers, building a target sequence structure that includes the plurality of remote controllers and target apparatus.

12. The method of claim 8, wherein at least one remote controller is a plurality of remote controllers, with at least one remote controller configured to receive intentional input from a user, and at least one remote controller configured to receive motion input from a user.

13. The method of claim 8, wherein the target apparatus has a motor configured to pulse its Output.

14. The method of claim 8, wherein at least one of the plurality of the target apparatus have a shaft for turning targets, the shaft having a switch or switches to determine a start point and an end point for the shaft's turn.

15. The method of claim 14, wherein at least one of the target apparatus is configured to time the amount of time taken for the shaft to turn between the start point and end point.

* * * * *